US009316061B2

(12) United States Patent
Hall et al.

(10) Patent No.: US 9,316,061 B2
(45) Date of Patent: Apr. 19, 2016

(54) HIGH IMPACT RESISTANT DEGRADATION ELEMENT

(76) Inventors: David R. Hall, Provo, UT (US); Marcus Skeem, Provo, UT (US); Francis Leany, Salem, UT (US)

( * ) Notice: Subject to any disclaimer, the term of this patent is extended or adjusted under 35 U.S.C. 154(b) by 737 days.

(21) Appl. No.: 13/208,103

(22) Filed: Aug. 11, 2011

(65) Prior Publication Data

US 2011/0291461 A1 Dec. 1, 2011

Related U.S. Application Data

(63) Continuation-in-part of application No. 11/673,634, filed on Feb. 12, 2007, now Pat. No. 8,109,349, and a continuation-in-part of application No. 12/619,305, filed on Nov. 16, 2009, now Pat. No. 8,567,532, which is a continuation-in-part of application No. 11/774,227, filed on Jul. 6, 2007, now Pat. No. 7,669,938, which is a continuation-in-part of application No. 11/773,271, filed on Jul. 3, 2007, now (Continued)

(51) Int. Cl.

| | |
|---|---|
| ***E21C 35/18*** | (2006.01) |
| ***E21B 10/567*** | (2006.01) |
| ***E21B 10/573*** | (2006.01) |
| ***E21C 35/183*** | (2006.01) |

(52) U.S. Cl.

CPC ..... *E21B 10/5673* (2013.01); *E21B 10/5676* (2013.01); *E21B 10/5735* (2013.01); *E21C 35/183* (2013.01); *E21C 2035/1816* (2013.01)

(58) Field of Classification Search

CPC ..... E21B 10/5735; E21B 10/54; E21B 2010/566; E21B 10/5673; E21B 10/42; E21B 10/43; E21C 2035/1816

USPC ..... 299/110, 111, 112 T, 113; 175/420.1, 175/420.2, 426, 427, 432, 434

See application file for complete search history.

(56) References Cited

U.S. PATENT DOCUMENTS

| | | | |
|---|---|---|---|
| 616,118 | A | 12/1889 | Kunhe |
| 465,103 | A | 12/1891 | Wegner |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford |
| 2,169,223 | A | 8/1931 | Christian |
| 1,821,474 | A | 9/1931 | Mercer |
| 1,879,177 | A | 9/1932 | Gault |
| 2,054,255 | A | 9/1936 | Howard |

(Continued)

FOREIGN PATENT DOCUMENTS

EP 0370199 * 5/1990 ..... E21B 10/46

*Primary Examiner* — John Kreck
*Assistant Examiner* — Carib Oquendo
(74) *Attorney, Agent, or Firm* — Philip W. Townsend, III

(57) ABSTRACT

In one aspect of the invention, a degradation element includes a substrate bonded to a sintered polycrystalline ceramic. The sintered polycrystalline ceramic has a tapering shape and a rounded apex. The rounded apex has a curvature with a 0.050 to 0.150 inch radius when viewed from a direction normal to a central axis of the degradation element that intersects the curvature. The rounded apex includes the characteristic of when the rounded apex is loaded against a rock formation, the rounded apex fails the rock formation forming a crushed barrier ahead of the rounded apex that shields the rounded apex from a virgin portion of the rock formation while still allowing the rounded apex to penetrate below a surface of the rock formation.

8 Claims, 8 Drawing Sheets

Related U.S. Application Data

Pat. No. 7,997,661, which is a continuation-in-part of application No. 11/766,975, filed on Jun. 22, 2007, now Pat. No. 8,122,980, which is a continuation-in-part of application No. 11/766,903, filed on Jun. 22, 2007, now abandoned, which is a continuation of application No. 11/766,865, filed on Jun. 22, 2007, now abandoned, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770, which is a continuation-in-part of application No. 11/673,634, filed on Feb. 12, 2007, now Pat. No. 8,109,349, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993.

(56) References Cited

U.S. PATENT DOCUMENTS

| | | | | |
|---|---|---|---|---|
| 2,064,255 | A | | 12/1936 | Garfield |
| 2,218,130 | A | | 10/1940 | Court |
| 2,320,136 | A | | 5/1943 | Kammerer |
| 2,466,991 | A | | 4/1949 | Kammerer |
| 2,540,464 | A | | 2/1951 | Stokes |
| 2,544,036 | A | | 3/1951 | Kammerer |
| 2,755,071 | A | | 7/1956 | Kammerer |
| 2,776,819 | A | | 1/1957 | Brown |
| 2,819,043 | A | | 1/1958 | Henderson |
| 2,838,284 | A | | 6/1958 | Austin |
| 2,894,722 | A | | 7/1959 | Buttolph |
| 2,901,223 | A | | 8/1959 | Scott |
| 2,963,102 | A | | 12/1960 | Smith |
| 3,135,341 | A | | 6/1964 | Ritter |
| 3,294,186 | A | | 12/1966 | Buell |
| 3,301,339 | A | | 1/1967 | Pennebaker |
| 3,379,264 | A | | 4/1968 | Cox |
| 3,429,390 | A | | 2/1969 | Bennett |
| 3,493,165 | A | | 2/1970 | Schonfield |
| 3,583,504 | A | | 6/1971 | Aalund |
| 3,764,493 | A | | 10/1973 | Rosar |
| 3,821,993 | A | | 7/1974 | Kniff |
| 3,955,635 | A | | 5/1976 | Skidmore |
| 3,960,223 | A | | 6/1976 | Kleine |
| 4,081,042 | A | | 3/1978 | Johnson |
| 4,106,577 | A | | 8/1978 | Summers |
| 4,109,737 | A | | 8/1978 | Bovenkerk |
| 4,176,723 | A | | 12/1979 | Arceneaux |
| 4,253,533 | A | | 3/1981 | Baker |
| 4,280,573 | A | | 7/1981 | Sudnishnikov |
| 4,304,312 | A | | 12/1981 | Larsson |
| 4,307,786 | A | | 12/1981 | Evans |
| 4,397,361 | A | | 8/1983 | Langford |
| 4,416,339 | A | | 11/1983 | Baker |
| 4,445,580 | A | | 5/1984 | Sahley |
| 4,448,269 | A | | 5/1984 | Ishikawa |
| 4,499,795 | A | | 2/1985 | Radtke |
| 4,531,592 | A | | 7/1985 | Hayatdavoudi |
| 4,535,853 | A | | 8/1985 | Ippolito |
| 4,538,691 | A | | 9/1985 | Dennis |
| 4,566,545 | A | | 1/1986 | Story |
| 4,574,895 | A | | 3/1986 | Dolezal |
| 4,640,374 | A | | 2/1987 | Dennis |
| 4,852,672 | A | | 8/1989 | Behrens |
| 4,889,017 | A | | 12/1989 | Fuller |
| 4,962,822 | A | | 10/1990 | Pascale |
| 4,981,184 | A | | 1/1991 | Knowlton |
| 5,009,273 | A | | 4/1991 | Grabinski |
| 5,027,914 | A | | 7/1991 | Wilson |
| 5,038,873 | A | | 8/1991 | Jurgens |
| 5,119,892 | A | | 6/1992 | Clegg |
| 5,141,063 | A | | 8/1992 | Quesenbury |
| 5,141,289 | A | * | 8/1992 | Stiffler ..... 299/111 |
| 5,186,268 | A | | 2/1993 | Clegg |
| 5,222,566 | A | | 6/1993 | Taylor |
| 5,255,749 | A | | 10/1993 | Bumpurs |
| 5,265,682 | A | | 11/1993 | Russell |
| 5,361,859 | A | | 11/1994 | Tibbitts |
| 5,410,303 | A | | 4/1995 | Comeau |
| 5,417,292 | A | | 5/1995 | Polakoff |
| 5,423,389 | A | | 6/1995 | Warren |
| 5,507,357 | A | | 4/1996 | Hult |
| 5,560,440 | A | | 10/1996 | Tibbitts |
| 5,568,838 | A | | 10/1996 | Struthers |
| 5,655,614 | A | | 8/1997 | Azar |
| 5,678,644 | A | | 10/1997 | Fielder |
| 5,706,906 | A | * | 1/1998 | Jurewicz et al. ..... 175/428 |
| 5,732,784 | A | | 3/1998 | Nelson |
| 5,794,728 | A | | 8/1998 | Palmberg |
| 5,848,657 | A | | 12/1998 | Flood |
| 5,896,938 | A | | 4/1999 | Moeny |
| 5,947,215 | A | | 9/1999 | Lundell |
| 5,950,743 | A | | 9/1999 | Cox |
| 5,957,223 | A | | 9/1999 | Doster |
| 5,957,225 | A | | 9/1999 | Sinor |
| 5,967,247 | A | | 10/1999 | Pessier |
| 5,979,571 | A | | 11/1999 | Scott |
| 5,992,547 | A | | 11/1999 | Caraway |
| 5,992,548 | A | | 11/1999 | Silva |
| 6,021,859 | A | | 2/2000 | Tibbitts |
| 6,039,131 | A | | 3/2000 | Beaton |
| 6,131,675 | A | | 10/2000 | Anderson |
| 6,150,822 | A | | 11/2000 | Hong |
| 6,186,251 | B1 | | 2/2001 | Butcher |
| 6,202,761 | B1 | | 3/2001 | Forney |
| 6,213,226 | B1 | | 4/2001 | Eppink |
| 6,223,824 | B1 | | 5/2001 | Moyes |
| 6,269,893 | B1 | | 8/2001 | Beaton |
| 6,296,069 | B1 | | 10/2001 | Lamine |
| 6,332,503 | B1 | | 12/2001 | Pessier |
| 6,340,064 | B2 | | 1/2002 | Fielder |
| 6,364,034 | B1 | | 4/2002 | Schoeffler |
| 6,394,200 | B1 | | 5/2002 | Watson |
| 6,408,959 | B2 | | 6/2002 | Bertagnolli |
| 6,439,326 | B1 | | 8/2002 | Huang |
| 6,474,425 | B1 | | 11/2002 | Truax |
| 6,484,825 | B2 | | 11/2002 | Watson |
| 6,484,826 | B1 | | 11/2002 | Anderson |
| 6,510,906 | B1 | | 1/2003 | Richert |
| 6,513,606 | B1 | | 2/2003 | Krueger |
| 6,533,050 | B2 | | 3/2003 | Molloy |
| 6,594,881 | B2 | | 7/2003 | Tibbitts |
| 6,601,454 | B1 | | 8/2003 | Botnan |
| 6,622,803 | B2 | | 9/2003 | Harvey |
| 6,668,949 | B1 | | 12/2003 | Rives |
| 6,672,406 | B2 | | 1/2004 | Beuershausen |
| 6,729,420 | B2 | | 5/2004 | Mensa-Wilmot |
| 6,732,817 | B2 | | 5/2004 | Dewey |
| 6,822,579 | B2 | | 11/2004 | Goswani |
| 6,929,076 | B2 | | 8/2005 | Fanuel |
| 6,953,096 | B2 | | 10/2005 | Glenhill |
| 2001/0004946 | A1 | | 6/2001 | Jensen |

(56) References Cited

U.S. PATENT DOCUMENTS

2003/0213621 A1 11/2003 Britten
2004/0238221 A1 12/2004 Runia
2004/0256155 A1 12/2004 Kriesels

* cited by examiner

HIGH IMPACT RESISTANT DEGRADATION ELEMENT

CROSS REFERENCE TO RELATED APPLICATIONS

This application is a continuation-in-part of U.S. patent application Ser. No. 11/673,634, which was filed on Feb. 12, 2007 and entitled Thick Pointed Superhard Material. This application is also a continuation-in-part of U.S. patent application Ser. No. 12/619,305, which is a continuation-in-part of U.S. patent application Ser. No. 11/766,975 and was filed on Jun. 22, 2007. This application is also a continuation-in-part of U.S. patent application Ser. No. 11/774,227 which was filed on Jul. 6, 2007. U.S. patent application Ser. No. 11/774,227 is a continuation-in-part of U.S. patent application Ser. No. 11/773,271 which was filed on Jul. 3, 2007. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 which was filed on Apr. 30, 2007. U.S. patent application Ser. No. 11/742,304 is a continuation of U.S. patent application Ser. No. 11/742,261 which was filed on Apr. 30, 2007. U.S. patent application Ser. No. 11/742,261 is a continuation-in-part of U.S. patent application Ser. No. 11/464,008 which was filed on Aug. 11, 2006. U.S. patent application Ser. No. 11/464,008 is a continuation-in-part of U.S. patent application Ser. No. 11/463,998 which was filed on Aug. 11, 2006. U.S. patent application Ser. No. 11/463,998 is a continuation-in-part of U.S. patent application Ser. No. 11/463,990 which was filed on Aug. 11, 2006. U.S. patent application Ser. No. 11/463,990 is a continuation-in-part of U.S. patent application Ser. No. 11/463,975 which was filed on Aug. 11, 2006. U.S. patent application Ser. No. 11/463,975 is a continuation-in-part of U.S. patent application Ser. No. 11/463,962 which was filed on Aug. 11, 2006. U.S. patent application Ser. No. 11/463,962 is a continuation-in-part of U.S. patent application Ser. No. 11/463,953, which was also filed on Aug. 11, 2006. The present application is also a continuation-in-part of U.S. patent application Ser. No. 11/695,672 which was filed on Apr. 3, 2007. U.S. patent application Ser. No. 11/695,672 is a continuation-in-part of U.S. patent application Ser. No. 11/686,831 filed on Mar. 15, 2007. This application is also a continuation in part of U.S. patent application Ser. No. 11/673,634. All of these applications are herein incorporated by reference for all that they contain.

BACKGROUND OF THE INVENTION

The present invention relates generally to a degradation element that may be driven by milling drums, mining drums, drill bits, chains, saws, mills, crushers, impacters, plows, or combination thereof. Specifically, the present invention deals with a degradation element comprising a substrate bonded to a sintered polycrystalline ceramic.

U.S. Patent Publication No. 2004/0065484 to McAlvain, which is herein incorporated for all that it contains, discloses a rotatable point-attack bit retained for rotation in a block bore, and used for impacting, fragmenting and removing material from a mine wall. An improved elongated tool body having at the front end a diamond-coated tungsten carbide wear tip that is rotationally symmetric about its longitudinal axis and contiguous with a second section steel shank at the rear end. The two distinct parts are joined by a high impact resistant braze at ratios that prevent tool breakage. The method of making such a diamond-coated section comprises of 1) placing within a reaction cell, the diamond powder and the carbide substrate and 2) simultaneously subjecting the cell and the contents thereof to temperature and pressure at which the diamond particles are stable and form a uniform polycrystalline diamond surface on the tip of the carbide substrate thus forming a diamond-coated insert providing both cutting edge and steel body protection for increased durability and extended cutting tool life.

U.S. Pat. No. 7,717,523 to Weaver, which is herein incorporated for all that it contains, discloses a cutting pick comprises an elongate shank and a cutting tip mounted to one end of the shank. The cutting tip has a leading end, a trailing end and a mounting portion for mounting to the shank. The tip has a shape such that it diverges outwardly in a direction from the leading end to the trailing end to a portion of maximum diameter. An annular sleeve is attached about the shank adjacent to and in non-contacting relationship with the trailing end of the cutting tip. The maximum diameter of the cutting tip is of greater diameter than the diameter of the inner diameter of the annular sleeve so that the portion of maximum diameter overlies the sleeve radially.

U.S. Pat. No. 6,918,636 to Dawood, which is herein incorporated for all that it contains, discloses the pick includes a radially inner end and a shank to be fixed to the drum to substantially prevent relative movement between the pick and drum. The pick further includes a cutting head having leading and trailing faces intersecting to provide a cutting edge to extend generally parallel to an axis. The leading face in use is inclined by an acute rake angle R to a radius of the axis, with the trailing face being inclined at an acute back clearance angle B to a plane passing through the edge and normal to the radius. The leading face and trailing face being inclined by an acute angle and the shanks when fixed to the drum extends at an acute angle to the radius.

BRIEF SUMMARY OF THE INVENTION

In one aspect of the invention, a degradation element includes a substrate bonded to a sintered polycrystalline ceramic. The sintered polycrystalline ceramic may comprise diamond. The sintered polycrystalline ceramic may have a metal catalyst concentration of less than eight percent and ninety five percent of the interstitial voids comprise a metal catalyst. In some embodiments, the sintered polycrystalline ceramic comprises cubic boron nitride.

The polycrystalline ceramic has a tapering shape and a rounded apex. The rounded apex has a curvature with a 0.050 to 0.150 inch radius when viewed from a direction normal to a central axis of the degradation element that intersects the curvature.

In some embodiments, the sintered polycrystalline ceramic is partitioned by a transition from the tapered shape to the rounded apex. The rounded apex may have a surface area of 0.0046 $in^2$ to 0.0583 $in^2$.

The rounded apex may comprise the characteristic of when the rounded apex is loaded against a rock formation the rounded apex fails the rock formation forming a crushed barrier ahead of the rounded apex that shields the rounded apex from a virgin portion of the rock formation while still allowing the rounded apex to penetrate below a surface of the rock formation.

The degradation element may comprise the characteristic that when the rounded apex is loaded against the rock formation along the central axis with 2,000 pounds of load into a rock formation comprising an unconfined compressive strength of 23,000 pounds per square inch (psi), the degradation element indents into the formation 0.018 to 0.026 inches and forms a 0.046 to 0.064 inch deep crater. In this embodiment the rock formation may be Terra Tek Sandstone.

In some embodiments, the degradation element comprises an additional characteristic of when the rounded apex is loaded against the rock formation at a non-vertical angle, the tapering shape is configured to wedge out fragments of the rock formation outside of the crushed barrier.

In some embodiments, the rounded apex is configured to compressively load the crushed barrier and the rock formation. The tapered shape may be configured to wedge up fragments of the rock formation thereby creating a tensile load between the crushed barrier and the surface of the formation.

The degradation element may comprise the characteristic that the degradation element is loaded against the rock formation along the central axis of the degradation element. The degradation element may be configured to be driven by a driving mechanism. The driving mechanism may be a rotary degradation drum; however, the driving mechanism may be a drill bit or a chain.

In some embodiments, the substrate comprises a first attachment end configured for attachment to the sintered polycrystalline ceramic and a second end configured for attachment to a degradation tool. The degradation element and the degradation tool may be rotationally fixed with respect to one another.

DETAILED DESCRIPTION OF THE INVENTION AND THE PREFERRED EMBODIMENT

Figure 1:
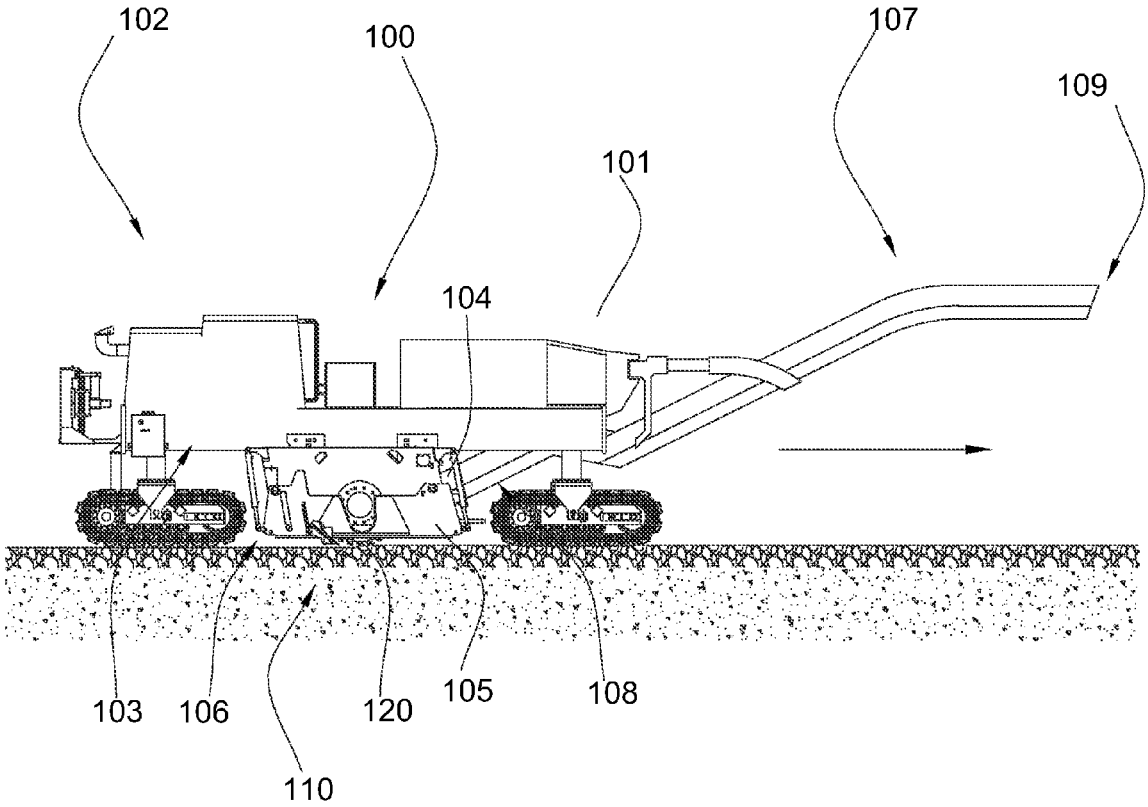
FIG. 1 is an orthogonal view of an embodiment of a machine.

FIG. 1 discloses an embodiment of a machine 100, such as a milling machine. The machine has a forward end 101 and a rearward end 102. An excavation chamber 110 is attached to the underside 103 of the machine's frame. The excavation chamber 110 is formed by a front plate 104, side plates 105, and a moldboard 106. The excavation chamber 110 encloses a driving mechanism 120, which is supported by the side plates. A conveyor 107 is also supported by the machine. An intake end 108 of the conveyor enters the excavation chamber 110 through an opening formed in the excavation chamber 110, usually formed in the front plate 104, but the opening may be formed in any portion of the excavation chamber 110. The driving mechanism 120 is configured to drop aggregate onto the conveyor proximate its intake end. The conveyor transports the aggregate from the intake end to the output end 109.

Figure 2:
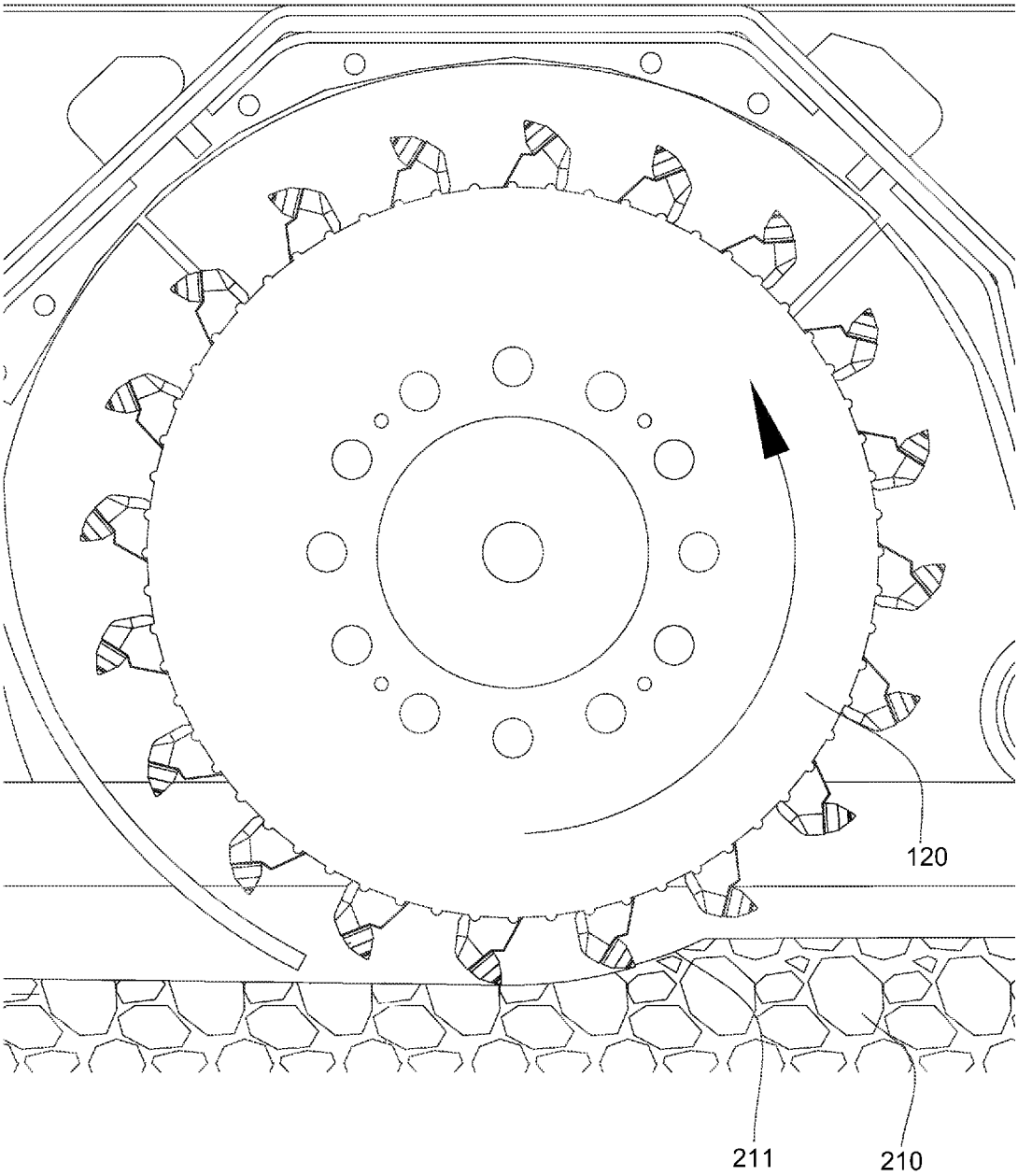
FIG. 2 is a cross sectional view of an embodiment of a driving mechanism.

FIG. 2 discloses the driving mechanism 120. A degradation element 200 may be configured to be driven by the driving mechanism 120. The degradation element 200 may be configured to be driven into a rock formation 210. The rock formation 210 may have a compressive strength that resists the degradation element 200 from failing the rock formation 210. The degradation element 200 may be configured to be driven with a load sufficient to fail the rock formation 210. In this embodiment, the degradation element 200 is configured to be driven by a rotary degradation drum. The rotary degradation drum may be a milling drum.

In some embodiments, the driving mechanism 120 may be a trenching drum, a trenching chain, a hammer mill, a jaw crusher, a cone crusher, an indenter, an impacter, a excavator bucket, a backhoe, a plow, chisels, or combinations thereof.

Figure 3A:
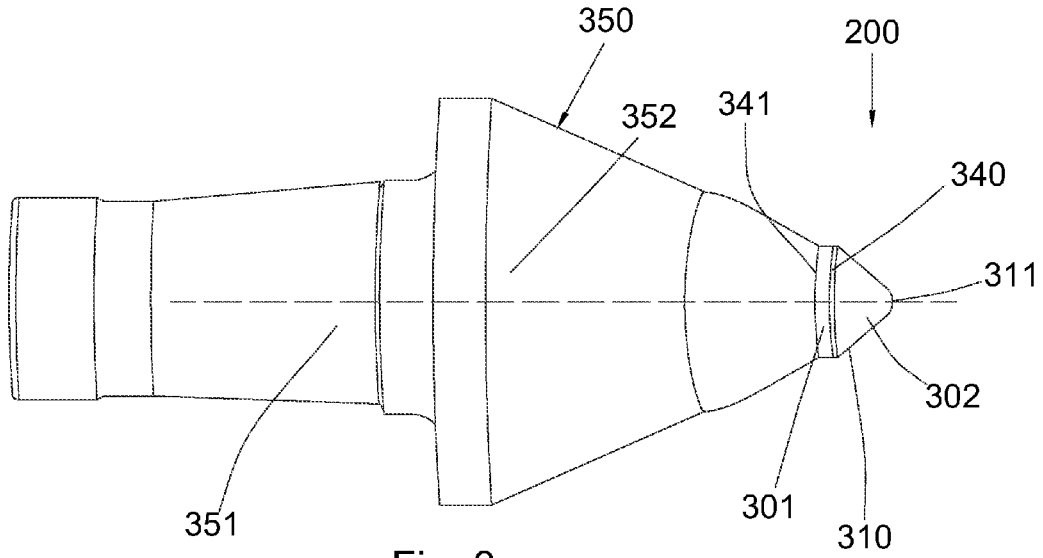
FIG. 3*a* is an orthogonal view of an embodiment of a degradation tool.

FIG. 3*a* discloses a degradation tool 350 and the degradation element 200. The degradation element may comprise a polycrystalline ceramic 302. The polycrystalline ceramic may have a tapered shape 310 and a rounded apex 311. The degradation element may also comprise a substrate 301. The substrate 301 may comprise a first attachment end 340 configured for attachment to the sintered polycrystalline ceramic 302 and a second attachment end 341 configured for attachment to the degradation tool 350. The degradation tool 350 may comprise a shank 351 connected to a body 352. The degradation element 200 may be attached to the body 352 of the degradation tool to form a tip. The degradation element 200 and the degradation tool 350 may be rotationally fixed with respect to one another.

Figure 3B:
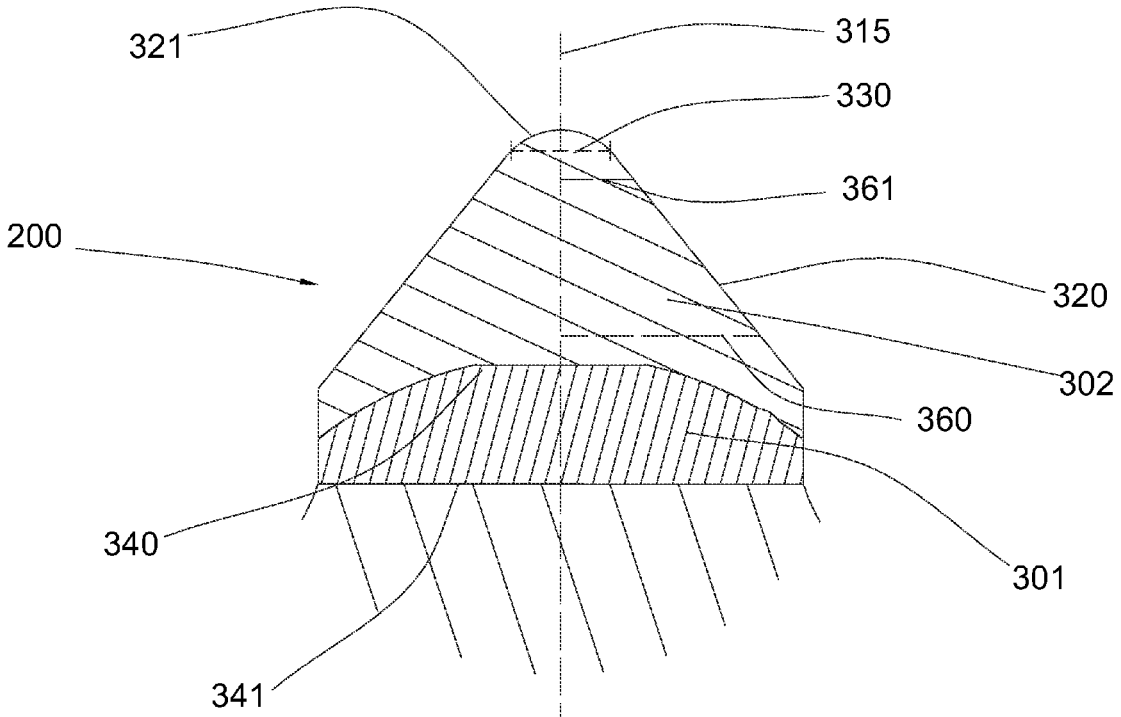
FIG. 3*b* is a cross sectional view of an embodiment of a degradation element.

FIG. 3*b* discloses the degradation element 200. The degradation element 200 may comprise the substrate 301 bonded to the sintered polycrystalline ceramic 302. The substrate 301 and the sintered polycrystalline ceramic 302 may be processed together in a high-pressure, high temperature press. In this embodiment, the sintered polycrystalline ceramic 302 comprises diamond. In some embodiments the sintered polycrystalline ceramic 302 comprises cubic boron nitride.

The sintered polycrystalline ceramic 302 may comprise a metal catalyst concentration of less than eight percent and at least ninety five percent of the interstitial voids comprise a metal catalyst. The metal catalyst may have a greater coefficient of thermal expansion than the ceramic 302, so when the ceramic 302 is subjected to high heat, the heat may cause the metal catalyst to expand faster than the ceramic 302, thereby, breaking bonds within and weakening the sintered polycrystalline ceramic 302. The sintered polycrystalline ceramic 302 can also be also weakened by a greater concentration of interstitial voids. Thus, the sintered polycrystalline ceramic 302 of the present invention, is stronger because of the reduced interstitial voids in the sintered polycrystalline ceramic 302.

In some embodiments, the degradation element may have a central axis 315 that intersects the rounded apex 311. Viewing the degradation element 200 from a direction normal to the central axis 315, the tapered shape 310 may have an outer sidewall 320 and the rounded apex 311 may have a curvature 321. The curvature 321 of the rounded apex 311 may have a 0.050 inch to 0.150 inch radius of curvature. The radius of curvature may be uniform along the curvature 321; however, in some embodiment the radius of curvature may vary along the curvature 321. Segments of the curvature 321 may have a radius of curvature greater than 0.150 inches and/or less than 0.050 inches.

In some embodiments, the sintered polycrystalline ceramic 302 is partitioned by a transition 330 from the tapered shape 310 to the rounded apex 311. The rounded apex 311 may have a surface area of 0.0046 $in^2$ to 0.0583 $in^2$.

The tapered shape may be a conical shape. The conical shape may have a base radius 360 that is proximate the substrate 301 and a tip radius 361 that is proximate the transition 330 from the tapered shape 310 to the rounded apex 311. The base radius 360 may be larger than the tip radius 361. In some embodiments, the tapered shape 310 may comprise a concave shape, a convex shape, a chisel shape, or a combination thereof. Several shapes that may be compatible with the present invention are disclosed in U.S. patent application Ser. No. 12/828,287, which is herein incorporated by reference for all that it discloses. In the preferred embodiment, the tapered shape 310 is symmetric with respect to the central axis 315; however, the tapered shape 310 may be asymmetric with respect to the central axis 315. The chisel shape may be asymmetric with respect to the central axis 315.

Figure 4:
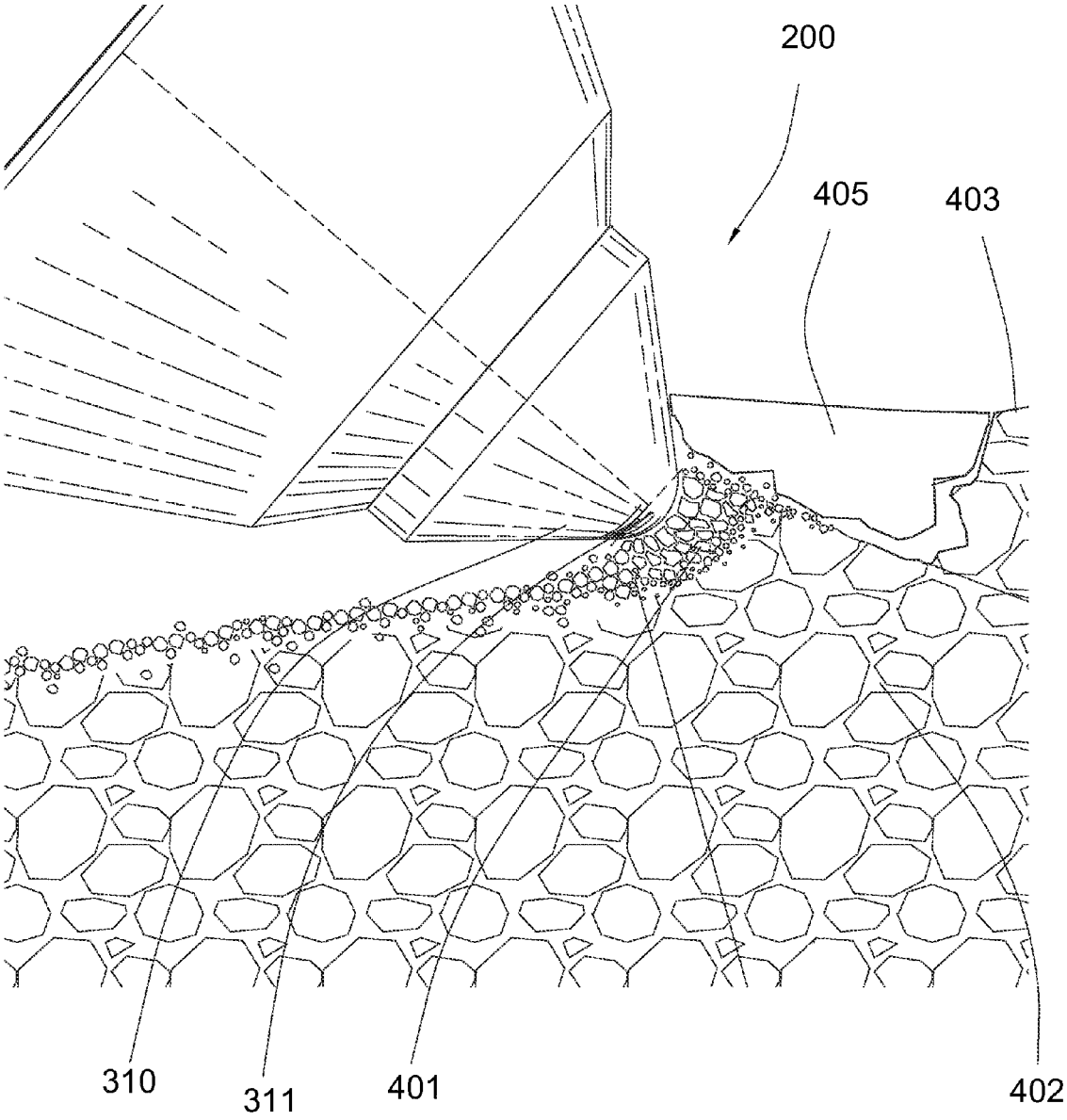
FIG. 4 is an orthogonal view of another embodiment of a degradation element.

FIG. 4 discloses the degradation element 200 engaging a rock formation 210. The rounded apex 311 may comprise the characteristic of when the rounded apex 311 is loaded against a rock formation 210, the rounded apex 311 fails the rock formation 210 by forming a crushed barrier 401 ahead of the rounded apex 311 that shields the rounded apex 311 from a virgin portion 402 of the rock formation while still allowing the rounded apex 311 to penetrate below a surface 403 of the rock formation.

The virgin portion 402 of the rock formation may require a specific amount of load to fail. Forces from the load that act on the rock formation 210 may also act on the rounded apex 311. Because the specific geometry of the rounded apex is critical for achieving the best results, protecting the rounded apex from wear may prolong the effective life of the tip. The forces that may wear, and therefore, change the shape of the rounded apex may include impact forces, compressive forces, and abrasive forces. When the polycrystalline ceramic comprises a low metal catalyst and few empty interstitial voids as described above, the tip is well suited to handle both the impact and compressive loads. Thus, the ceramic is more susceptible to abrasive wear. So, when the tip comprises a curvature that is blunt enough to crush the formation ahead of itself, but the apex radius also has a minimal surface area as described above, the tip may penetrate deeply into the formation and still form a crushed zone or barrier 401 ahead of the tip. The crushed barrier shields the rounded apex 311 from the abrasive force of the virgin portion 402 of the rock formation. Testing has shown that the abrasive loads from the virgin rock cause less wear to the rounded apex than wear from the crushed barrier. Thus, the crushed barrier serves to preserve/shield the curvature of the apex from wearing which continues to allow the tip to penetrate and crush simultaneously.

In some embodiments, the degradation element 200 may comprise the characteristic that the degradation element 200 is loaded against the rock formation 210 along the central axis 315 of the degradation element 200. The load may be transferred from the degradation element 200 to the rock formation 210 substantially through the rounded apex 311 in such a manner that the rounded apex 311 penetrates into the surface 403 of the rock formation. The geometry of the rounded apex 311 may be configured to compressively fail the rock formation 210 immediately ahead of the rounded apex 311 forming a crushed barrier 401 that shields the rounded apex 311 from the virgin portion 402 of the rock formation.

In some embodiments, the degradation element 200 may comprise an additional characteristic of when the rounded apex 311 is loaded against the rock formation 210 at a non-vertical angle, the tapering shape 310 is configured to wedge out fragments 405 of the rock formation outside of the crushed barrier 401. The tapered shape 310 may be configured to push the fragments 405 out of the rock formation 210 in a direction substantially perpendicular to the surface 403 of the rock formation.

In some embodiments, the rounded apex 311 is configured to compressively load the crushed barrier 401 and the rock formation 210. The tapered shape 310 may be configured to wedge up fragments 405 of the rock formation thereby creating a tensile load between the crushed barrier 401 and the surface 403 of the formation.

Figure 5:
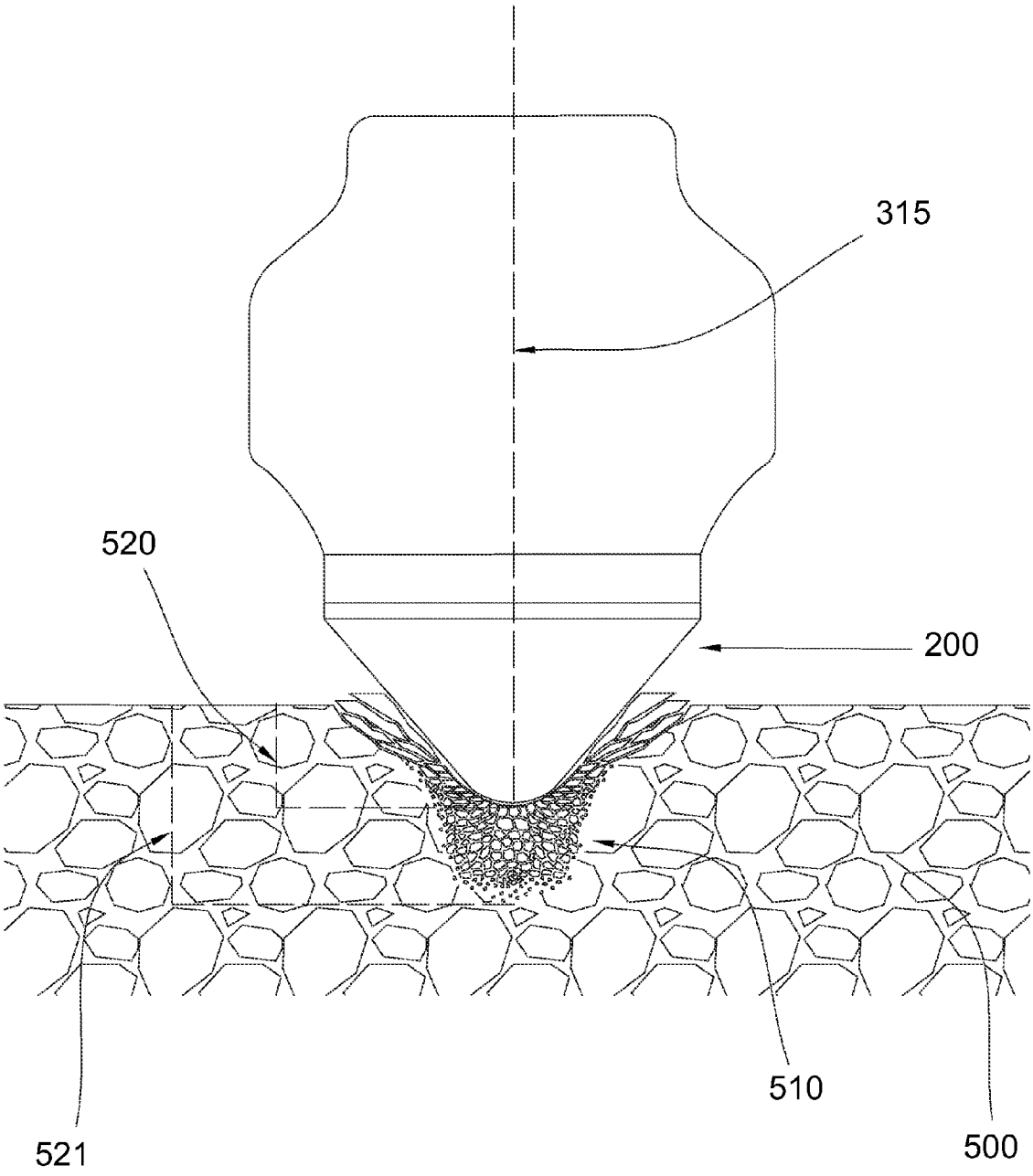
FIG. 5 is an orthogonal view of another embodiment of a degradation element.

FIG. 5 discloses the degradation element 200 engaging a sandstone rock formation 500. The degradation element 200 may comprise the characteristic that when the rounded apex 311 is loaded against the sandstone rock formation 500 along the central axis 315 with 2,000 pounds of load into the sandstone rock formation 500 comprising an unconfined compressive strength of 23,000 pounds per square inch (psi), the degradation element 200 indents into the sandstone rock formation 0.018 to 0.026 inches and forms a 0.046 to 0.064 inch deep crater 510. In this embodiment, the sandstone rock formation 500 may be Sandstone. The indention may be a depth 520 that the degradation element penetrates into the rock formation. The crater depth 521 may be the sum of the indention depth and a depth of the crushed barrier.

Figure 6:
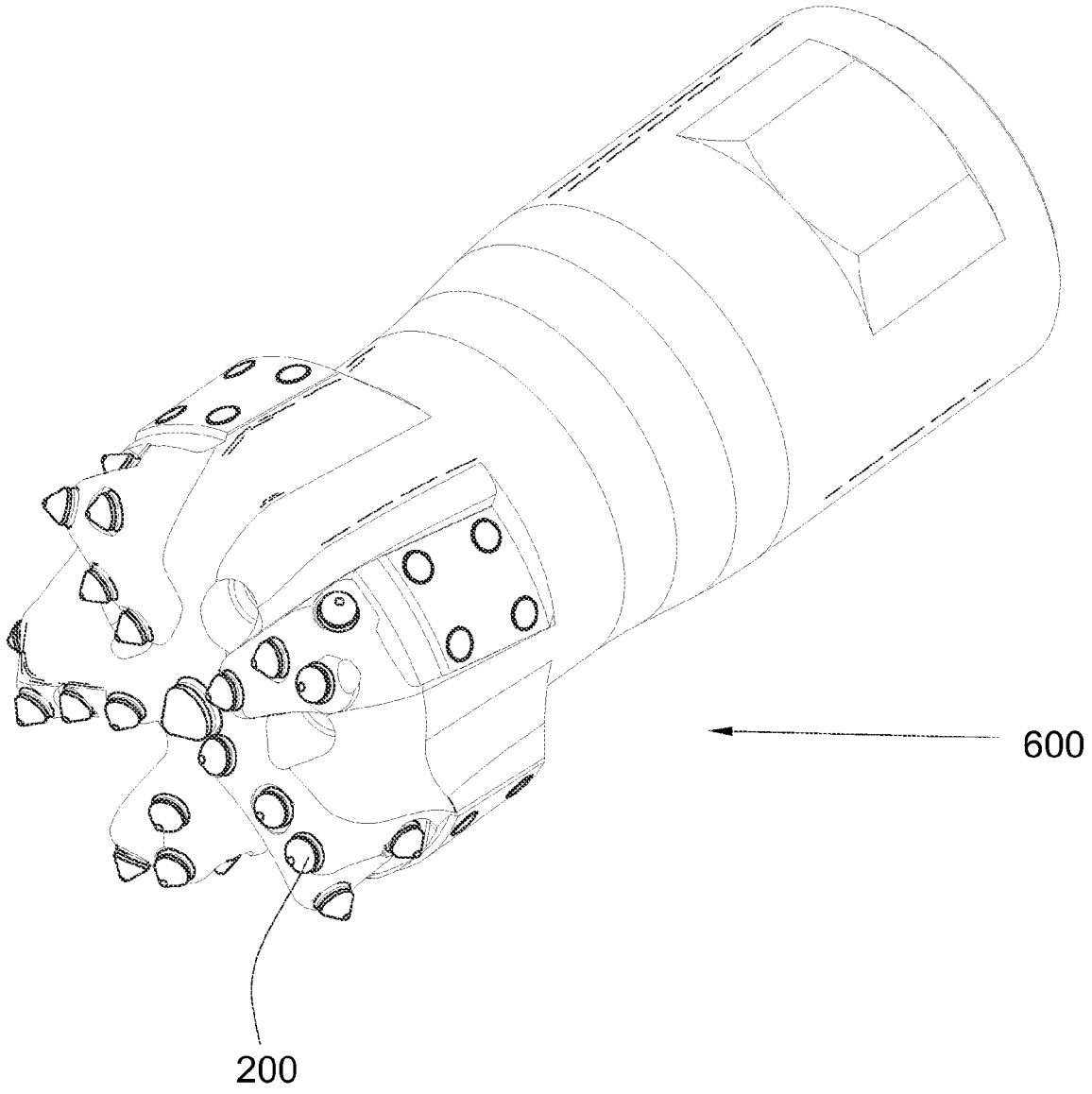
FIG. 6 is a perspective view of another embodiment of a driving mechanism.

FIG. 6 discloses a drill bit 600. In some embodiments, the driving mechanism 120 is a drill bit 600. The degradation element 200 may be configured to be driven by the drill bit 600 into the rock formation. The drill bit 600 may be a roller cone bit, a fixed bladed bit, a waterwell bit, a horizontal bit, a percussion drill bit, or combinations thereof.

Figure 7:
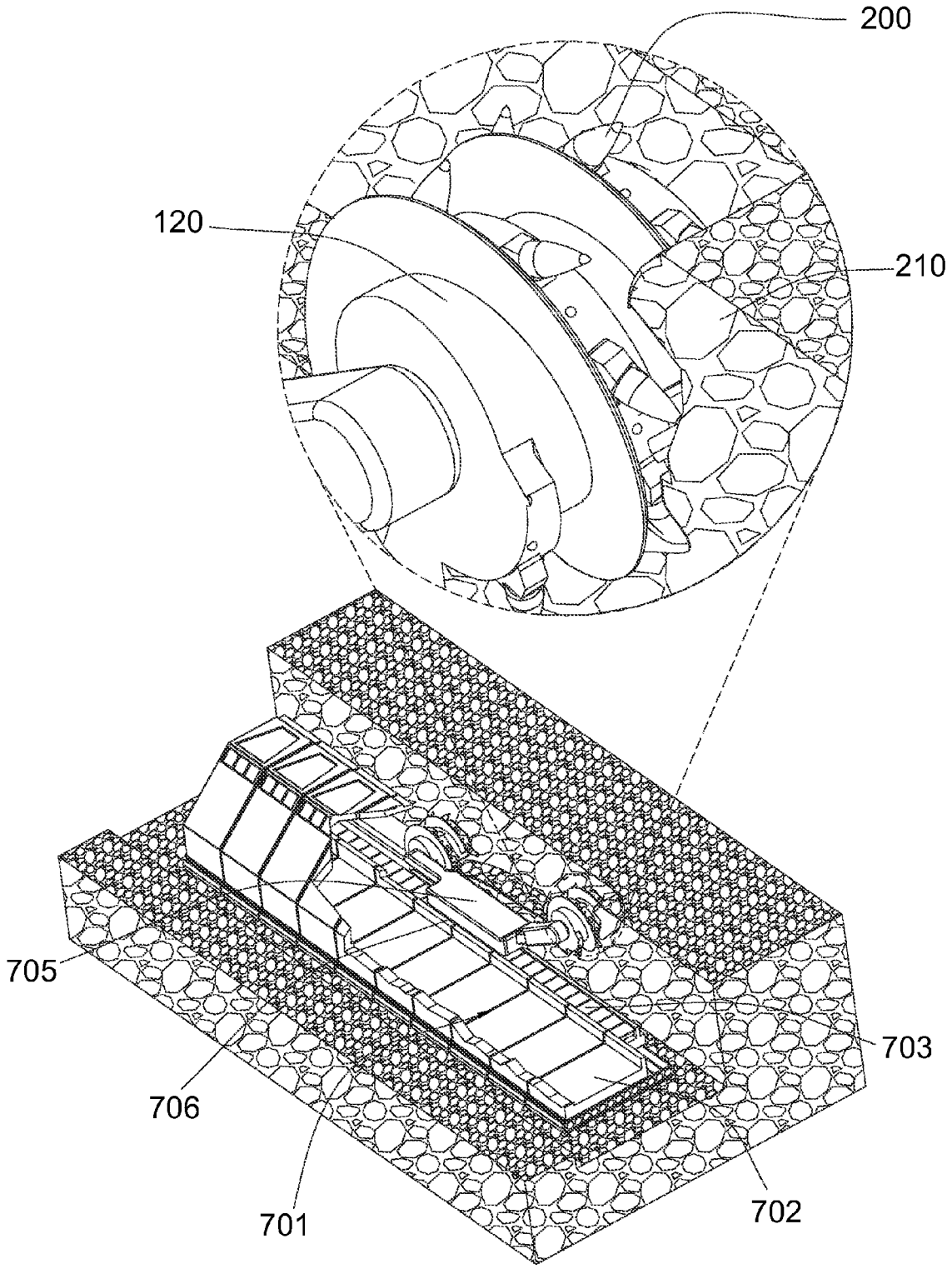
FIG. 7 is a perspective view of another embodiment of a machine.

FIG. 7 discloses another embodiment of a machine 100, such as a long wall miner. The machine 100 may comprise a main frame 701 on endless tracks 702. A conveyor 703 may be attached to the main frame 701. The conveyor 703 may be configured to transport aggregate away from the excavation site. A moveable arm 705 may be attached to the main frame 701. The movable arm 705 may move along a track 706 that runs substantially parallel to the front side of the machine 100. The driving mechanism 120 may be supported by the movable arm 705. The driving mechanism 120 may be guided by the movable arm 705 to engage the rock formation 210 in a lateral direction with respect to the main frame 701. The driving mechanism 120 may be an excavation drum.

Figure 8:
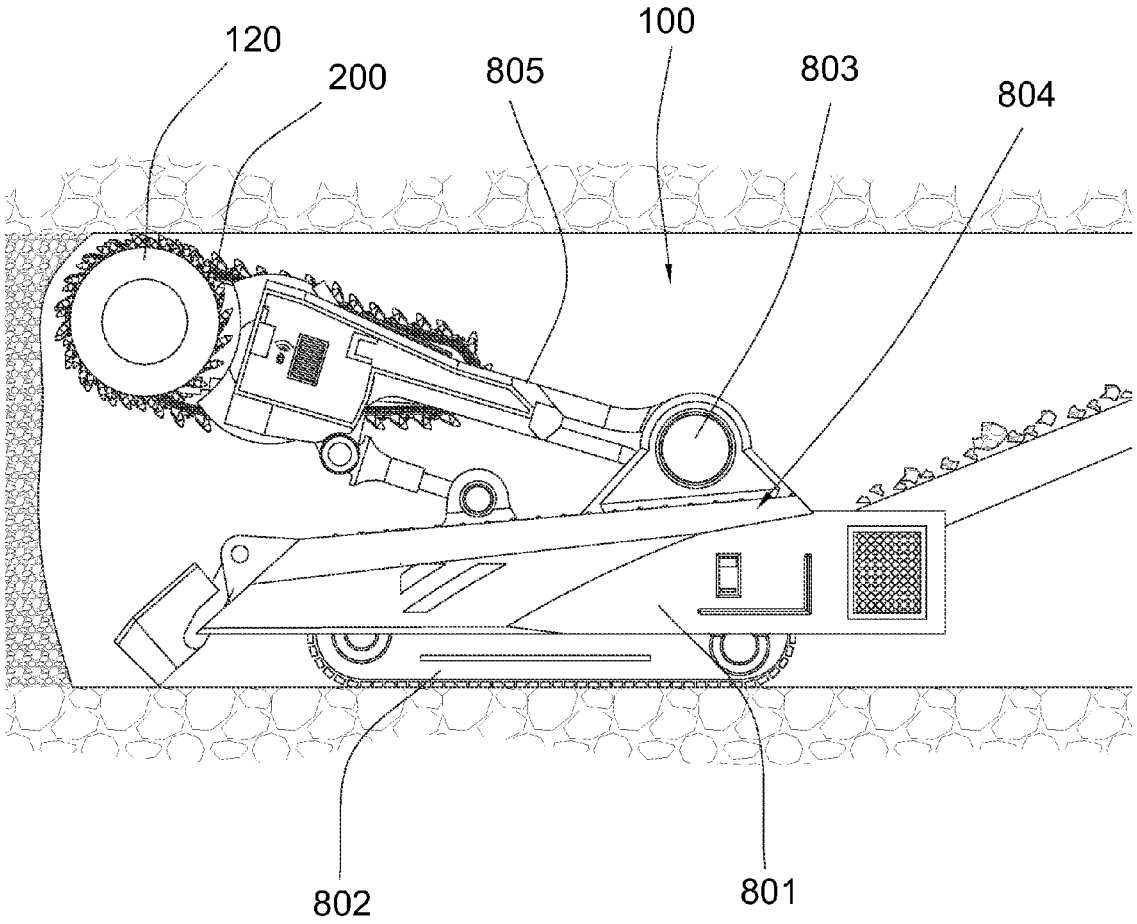
FIG. 8 is an orthogonal view of another embodiment of a machine.

FIG. 8 discloses another embodiment of a machine 100, such as a continuous miner. The machine 100 may comprise a main frame 801 on continuous tracks 802. A turret 803 may be attached to the topside 804 of the main frame 801. A pair of forwardly directed loading arms 805 may be attached to the turret 803. The driving mechanism 120 may be supported by the loading arms 805. The loading arms 805 may be configured to lift and lower the driving mechanism 120. The driving mechanism 120 may be a chain. The degradation element 200 may be configured to be driven by the chain. In some embodiments the driving mechanism 120 is an excavation drum.

Whereas the present invention has been described in particular relation to the drawings attached hereto, it should be understood that other and further modifications apart from those shown or suggested herein, may be made within the scope and spirit of the present invention.

What is claimed is:

1. A method of degrading a rock formation, comprising:

providing a degradation element comprising a substrate bonded to a sintered polycrystalline ceramic comprising a tapering shape and a rounded apex, the rounded apex comprising a curvature with a 0.050 to 0.150 inch radius when viewed from a direction normal to a central axis of the degradation element that intersects the curvature;

loading the degradation element along a central axis of the degradation element with 2,000 pounds of load against the rock formation comprising an unconfined compressive strength of 23,000 pounds per square inch, indenting the degradation element into the rock formation 0.018 to 0.026 inches, and forming a 0.046 to 0.064 inch deep crater;

crushing a portion of the rock formation to form a shield; and forcing the shield against a virgin portion of the rock formation with the degradation element to fracture the virgin portion.

2. The method of degrading a rock formation of claim 1, wherein the loading the degradation element against the rock formation occurs at a non-vertical angle.

3. The method of degrading a rock formation of claim 1, wherein the forcing the shield against a virgin portion creates a tensile load between the shield and a surface of the rock formation.

4. The method of degrading a rock formation of claim 1, wherein the step of forcing the shield against the virgin portion comprises wedging fragments out of the virgin portion.

5. The method of degrading a rock formation of claim 4, wherein the fragments are forced in a direction substantially perpendicular to a surface of the rock formation.

6. The method of degrading a rock formation of claim 1, wherein failed fragments of the rock formation create shield replacement material.

7. The method of degrading a rock formation of claim 1, including the step of driving the degradation element by a driving mechanism, a rotary degradation drum, an excavation drum, a drill bit, a chain, a milling drum, an impacter, an excavator bucket, a hammer mill, a jaw crusher, a cone crusher, a trenching drum, an indenter, a backhoe, a plow, a chisel, or a combination thereof.

8. The method of degrading a rock formation of claim 1, including the step of fixing the degradation element rotationally with respect to a degradation tool.

* * * * *